US011006226B2

(12) United States Patent
Krogsgaard et al.

(10) Patent No.: US 11,006,226 B2
(45) Date of Patent: May 11, 2021

(54) BINAURAL HEARING AID SYSTEM AND A METHOD OF OPERATING A BINAURAL HEARING AID SYSTEM

(71) Applicant: WIDEX A/S, Lynge (DK)

(72) Inventors: Klaus Krogsgaard, Lyngby (DK); Michael Ungstrup, Allerod (DK)

(73) Assignee: Widex A/S, Lynge (DK)

( * ) Notice: Subject to any disclaimer, the term of this patent is extended or adjusted under 35 U.S.C. 154(b) by 59 days.

(21) Appl. No.: 16/497,251

(22) PCT Filed: Mar. 21, 2018

(86) PCT No.: PCT/EP2018/057163
§ 371 (c)(1),
(2) Date: Sep. 24, 2019

(87) PCT Pub. No.: WO2018/177839
PCT Pub. Date: Oct. 4, 2018

(65) Prior Publication Data

US 2020/0382880 A1 Dec. 3, 2020

(30) Foreign Application Priority Data

Mar. 28, 2017 (DK) ..... PA201700215

(51) Int. Cl.
*H04R 25/00* (2006.01)

(52) U.S. Cl.
CPC ..... *H04R 25/552* (2013.01); *H04R 25/554* (2013.01); *H04R 2225/55* (2013.01)

(58) Field of Classification Search
CPC . H04R 25/552; H04R 25/554; H04R 2225/55
USPC ..... 381/23.1
See application file for complete search history.

(56) References Cited

U.S. PATENT DOCUMENTS

2010/0054512 A1* 3/2010 Solum ..... H04R 25/30 381/315
2016/0037270 A1* 2/2016 Polinske ..... H04R 25/558 381/315
2018/0234777 A1* 8/2018 Roeck ..... H04L 1/0014

FOREIGN PATENT DOCUMENTS

EP 2 439 960 A1 4/2012
EP 2 871 857 A1 5/2015
EP 2 942 978 A1 11/2015
EP 2 534 853 B1 11/2016
EP 2 119 310 B1 12/2016
WO 2008/089784 A1 7/2008

OTHER PUBLICATIONS

International Search Report for PCT/EP2018/057163 dated Jun. 6, 2018 [PCT/ISA/210].

* cited by examiner

*Primary Examiner* — Sean H Nguyen
(74) *Attorney, Agent, or Firm* — Sughrue Mion, PLLC

(57) ABSTRACT

A binaural hearing aid system (100) with improved diversity properties. The invention also provides a method for operating such a binaural hearing aid system (100).

15 Claims, 1 Drawing Sheet

BINAURAL HEARING AID SYSTEM AND A METHOD OF OPERATING A BINAURAL HEARING AID SYSTEM

CROSS REFERENCE TO RELATED APPLICATIONS

This application is a National Stage of International Application No. PCT/EP2018/057163, filed on Mar. 21, 2018, which claims priority from Danish Patent Application No. PA201700215, filed on Mar. 28, 2017.

The present invention relates to a method of operating a binaural hearing aid system. The present invention also relates to a binaural hearing aid system adapted to carry out said method.

BACKGROUND OF THE INVENTION

Generally a hearing aid system according to the invention is understood as meaning any device which provides an output signal that can be perceived as an acoustic signal by a user or contributes to providing such an output signal, and which has means which are customized to compensate for an individual hearing loss of the user or contribute to compensating for the hearing loss of the user. They are, in particular, hearing aids which can be worn on the body or by the ear, in particular on or in the ear, and which can be fully or partially implanted. However, some devices whose main aim is not to compensate for a hearing loss, may also be regarded as hearing aid systems, for example consumer electronic devices (televisions, hi-fi systems, mobile phones, MP3 players etc.) provided they have, however, measures for compensating for an individual hearing loss.

Within the present context a traditional hearing aid can be understood as a small, battery-powered, microelectronic device designed to be worn behind or in the human ear by a hearing-impaired user. However, the hearing aid may be powered in any suitable way such as by a fuel cell. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

Within the present context a binaural hearing aid system comprises two hearing aids, one for each ear of the hearing aid user. Therefore so called Contra-lateral Routing Of Signal (CROS) hearing aids and Bi-lateral Contra-lateral Routing Of Signal (BiCROS) hearing aids, are in the present context considered binaural hearing aid systems, because they comprise two devices, one for each ear of the hearing aid user. Thus in the following context a CROS or BiCROS device is considered a hearing aid despite that it may not comprise an acoustic output transducer.

Furthermore, the hearing aid system may comprise an external device, such as a smart phone having software applications adapted to interact with other devices of the hearing aid system. Thus within the present context the term "hearing aid system device" may denote a traditional hearing aid, an external device, a CROS device or a BiCROS device.

The mechanical design has developed into a number of general categories. As the name suggests, Behind-The-Ear (BTE) hearing aids are worn behind the ear. To be more precise, an electronics unit comprising a housing containing the major electronics parts thereof is worn behind the ear. An earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit and to the ear canal. In some modern types of hearing aids, a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids.

In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid.

Auxiliary devices such as e.g. remote controls or smart phones adapted for use with hearing aids are known. They offer a convenient way of operating various user-accessible features of a hearing aid such as volume level and program selection.

Some contemporary hearing aids are provided with a 2.4 GHz wireless link that allows direct communication between an auxiliary device and the hearing aid. However the quality of this type of wireless transmission may suffer due to e.g. shadowing effects and in case the wireless link is used for longer periods of time, such as when streaming audio from the auxiliary device and to the hearing aid then a significant power consumption may result.

It has been suggested, e.g. it is an option in the Bluetooth Low Energy (BT LE) standard, to use data packet re-transmission in order to alleviate low wireless transmission quality (due to lost data packets) but the downside of this solution is that it introduces an additional transmission delay that may deteriorate the quality of e.g. transmitted audio signals and in some cases data packet re-transmission may not be capable of solving the issue of lost data packets (which may also be denoted fall outs).

EP-A1-2871857 discloses a method wherein data packets, received in a hearing aid from an auxiliary device using a far-field wireless link, are relayed to the other hearing aid, using a near-field wireless link, in response to a detection of a low quality of the far-field wireless link. Thus relaying is only initiated in response to a detection of a problematic situation and this inevitably adds to the latency.

EP-A1-2439960, is similar to EP-A1-2871857 in so far that the primary focus is on conditional relaying, i.e. that data received by one hearing aid is only transmitted to the other hearing aid in response to some trigger event.

EP-B1-2534853 discloses a method wherein an audio signal is transmitted to a receiver unit with two spaced-apart antennas both adapted for receiving the audio signal, whereby multi-path fading resulting from destructive interference may be alleviated. However, for a hearing aid, where space is a scarce resource it is disadvantageous to incorporate two antennas and corresponding digital circuitry for receiving the same signal.

EP-B1-2119310 discloses a method wherein the quality of a far-field wireless link between an auxiliary device and the two hearing aids of a binaural hearing aid system is monitored and in case a quality measure for the link to one of the hearing aids is significantly lower than the quality measure for the link to the other of the hearing aids or in case the quality measure for one of the links falls below some predetermined threshold then relaying using the near-field wireless link between the hearing aids is initiated. This method may be considered disadvantageous because it is based on conditional relaying and because it does not consider the quality of the data that is ultimately received due to the relaying.

It is therefore a feature of the present invention to provide an improved method of transmitting data from an auxiliary device and to the hearing aids of a binaural hearing aid system.

It is another feature of the present invention to provide a binaural hearing aid system adapted to provide such a method of operating a binaural hearing aid system.

SUMMARY OF THE INVENTION

The invention, in a first aspect, provides a binaural hearing aid system comprising: a first hearing aid, a second hearing aid and an auxiliary device; a wireless inductive link adapted to transmit data packets between the first and second hearing aids; a wireless far-field link adapted to transmit data packets from the auxiliary device and to the first and second hearing aid respectively; wherein both the first and the second hearing aid comprises: a relay processor adapted to relay data packets received from the auxiliary device, using the wireless radio link, to the other hearing aid of the binaural hearing aid system, using said wireless inductive link; a quality estimator adapted to estimate the quality of the data packets received from the auxiliary device using the wireless radio link and adapted to estimate the quality of the data packets received from the other hearing aid of the binaural hearing aid system using the wireless inductive link, wherein the quality estimation is carried out as a data packet validity check selected from a group comprising cyclic redundancy cheek, parity bit check and hash sum check; and a selector adapted to select either a data packet received from the contra-lateral hearing aid of the binaural hearing aid system or a data packet received from the auxiliary device for further processing by the hearing aid, wherein the selection depends on the data packet validity check.

This provides a binaural hearing aid system with improved means for operating a hearing aid system.

The invention, in a second aspect, provides a method of operating a hearing aid system comprising the steps of:

- providing a first hearing aid, a second hearing aid and an auxiliary device;
- providing an wireless inductive link adapted to operationally connect said hearing aids;
- providing a wireless far-field link adapted to operationally connect said auxiliary device with each of said hearing aids;
- transmitting a data packet, using said wireless far-field link, from the auxiliary device and to each of said hearing aids;
- carrying out in each of the two hearing aids the steps of using said wireless inductive link to relay the data packet to the contra-lateral hearing aid;
- estimating, the quality of the data packet received directly from the auxiliary device, hereby providing a first data packet quality estimate;
- estimating, the quality of the data packet received from the contra-lateral hearing aid hereby providing a second data packet quality estimate;
- selecting, either the data packet received directly from the auxiliary device or the data packet received from the contra-lateral hearing aid based on an evaluation of said first and second signal quality estimates;
- using the selected data packet for further processing, and
- wherein the steps of estimating the data packet quality is carried out by performing a data packet validity check selected from a group comprising cyclic redundancy check, parity bit check and hash sum check.

This provides an improved method of operating a binaural hearing aid system with respect to transmission of data from an auxiliary device and to the hearing aids of the binaural hearing aid system.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

Figure 1:
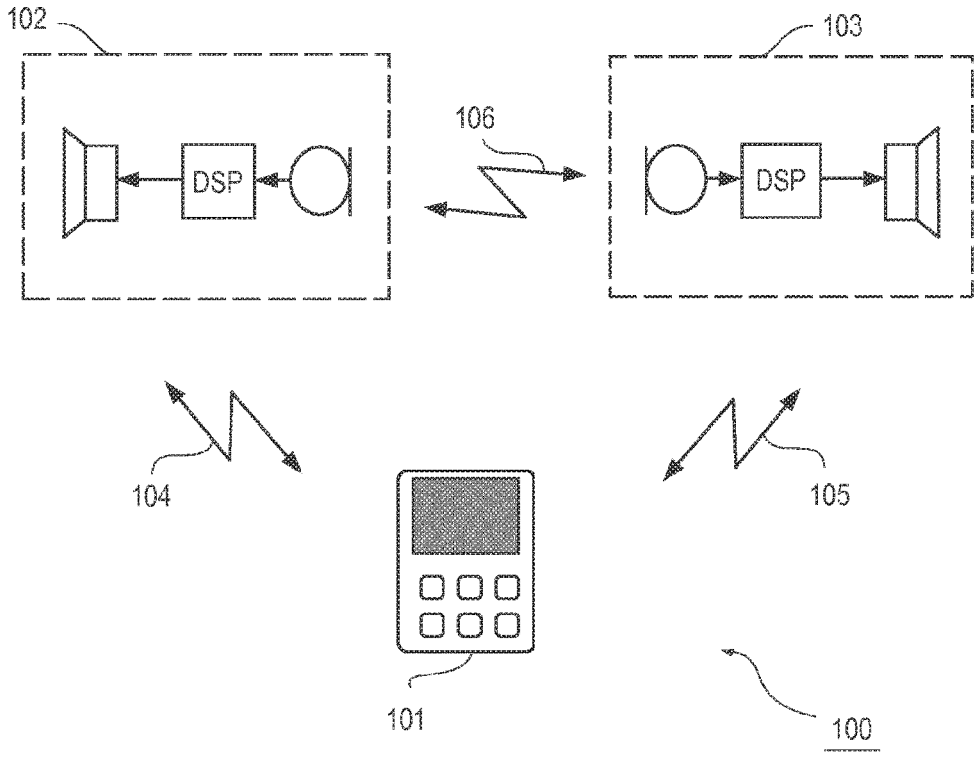
FIG. 1 illustrates highly schematically a binaural hearing aid system according to an embodiment of the invention.

Reference is first made to FIG. 1, which illustrates highly schematically a binaural hearing aid system 100 according to an embodiment of the invention. The binaural hearing aid system 100 comprises an auxiliary device 101, a first hearing aid 102 and a second hearing aid 103.

Each of the hearing aids 102, 103 comprise an inductive antenna and a corresponding wireless transceiver whereby a wireless inductive link 106 (which may also be denoted a near-field radio or near-field link) is provided such that data packets can be transmitted between the two hearing aids. Within the present context a wireless link configured to operate in the range between 1 and 20 MHz, preferably around 10 MHz may be denoted a near-field link.

Additionally each of the hearing aids 102, 103 and the auxiliary device 101 comprise a far-field antenna and a corresponding wireless transceiver whereby wireless far-field link 104, 105 (which may also be denoted far-field radio) is provided between each of the hearing aids 102, 103 and the auxiliary device 101 such that data packets can be transmitted between the auxiliary device 101 and each of the two hearing aids 102, 103.

Within the present context a wireless link configured to operate at 2.4 GHz, or in variations in the range between 0.5 and 6 GHz may be denoted a far-field link. In embodiments the far-field link 104, 105 is set up to communicate using the Bluetooth (BT) version 4 protocol, also known as Bluetooth Low Energy (BT-LE) and standardized by the Bluetooth Special Interest Group. In some variations other and later versions of the BT protocol may be used and in yet other variations other wireless link means and corresponding connection based protocols such as e.g. HomeRF, DECT or wireless LAN can be used.

In variations the auxiliary device 101 may be a hearing aid remote control, a smart phone, a television, a public announcement system or some device capable of broadcasting a far-field signal. In case the auxiliary device 101 is a smart phone the functionality required to set-up the wireless far-field link 104, 105 and to control the transmission and receipt of data packets may be downloaded to the auxiliary device 101 as a small application program, e.g. a so-called "app".

Figure 2:
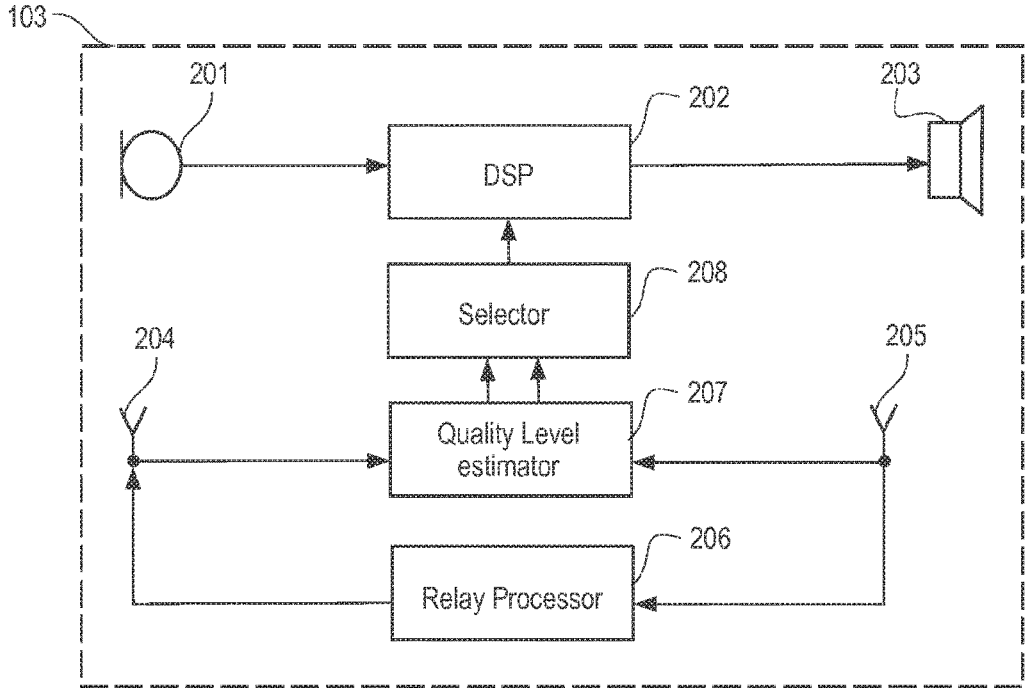
FIG. 2 illustrates highly schematically a hearing aid according to an embodiment of the invention.

Reference is now made to FIG. 2, which illustrates highly schematically one of the hearing aids 102, 103 of the binaural hearing aid system 100 according to an embodiment of the invention. According to the embodiment both of the hearing aids are configured to operate in the same manner, therefore only one of the hearing aids 103 are considered in the following.

The hearing aid 103 comprises an acoustical-electrical input transducer 201, a digital signal processor (DSP) 202, an electrical-acoustical output transducer 203 (which may also be denoted a receiver or a loudspeaker), an inductive antenna 204 and a corresponding transceiver (not shown), a far-field antenna 205 and a corresponding transceiver (not shown), a relay processor 206, a quality level estimator 207 and a selector 208.

When a data packet is received by the far-field antenna 205 it is subsequently provided to both the relay processor 206 and the quality level estimator 207. As opposed hereto a data packet received by the inductive antenna 204 is only provided to the quality level estimator 207.

The relay processor 206 is configured to provide that the received data packet is retransmitted to the contra-lateral hearing aid using the wireless inductive link comprising the inductive antenna 204. Furthermore the relay processor 206 is configured to ensure that the relaying of the data packet is carried out with a minimum of processing delay. This is at least partly achieved by omitting quality estimation and decoding of the data packets prior to being relayed over the wireless inductive link.

In variations it may also be considered to decode the data packet before relaying and hereby relay data representing audio without the use of an audio codec for compressing the data to be transmitted. However, generally this is considered less advantageous at least because of the additional bandwidth required for the relay of uncompressed data representing audio.

The quality level estimator 207 is adapted to read, for each received data packet, a stored first value of a data validity measure for the originally transmitted payload of the data packet and adapted to calculate a second value of the data validity measure for the received payload data. Subsequently the first and second value of the data validity measure are compared and the result is provided to the selector 208, wherein the result is that either the values are equal or the values are not equal and if the values are equal then the payload data are considered valid and otherwise the payload data are considered corrupted.

The data validity measure may be selected from a group comprising Cyclic Redundancy Check (CRC), parity check or a hash sum check.

In a variation the quality level estimator 207 is adapted to process two data packets simultaneously such that no unnecessary additional processing delay is added. However, it is noted that this potential additional processing delay is relatively small because the decoding of the data payload, which generally is required if the data payload represents audio and which is the most time consuming part of the data packet processing may not need to be carried out in order to determine the data validity.

The selector 208 is adapted to receive two data packets, both representing a data packet originally transmitted from the auxiliary device 101, and wherein the two data packets only differ in that a first one of the data packets is transmitted directly to the hearing aid 103 using the far-field wireless link 105 and a second one of the data packets is relayed from the other hearing aid 102 using the inductive wireless link 106.

In variations the selector 208 or the quality level estimator 207 has incorporated a time delay for the first one of the data packets in order to ensure that the selector 208 selects one of two received data packets that represent the same originally transmitted data packet from the auxiliary device 101.

In another variation the selector 208 or the quality level estimator 207 checks packet order information in order to ensure that data packets holding the same payload are selected between.

The selector 208 is further adapted to select a data packet with payload data that are considered valid. This selected data packed is subsequently provided to the digital signal processor 202 of the hearing aid 103 for further processing. The further processing may comprise decoding of payload data representing audio and standard hearing aid processing including noise reduction and amplification in order to alleviate an individual hearing loss. In a specific variation the further processing does not include amplification in order to alleviate an individual hearing loss.

If both data packets are considered valid either can obviously be selected. However, it may be considered in this case to always use the data packet received by the far-field antenna 205 because this data packet statistically will be less corrupted than a data packet that has been relayed and therefore received by the inductive antenna 204.

In case both data packets are considered corrupted, both data packets will be discarded and no data packet provided to the digital signal processor 202. However, in a variation it may be considered in such a case to evaluate and compare a second data quality estimate such as Received Signal Strength Indicator (RSSI) or Received Signal Code Power (RSCP) and possibly apply the data packet with the highest second data quality estimate. In a further variation it may be considered to apply a packet loss concealment technique for one of the data packets despite that the data packets are considered corrupted.

In a variation the data packet received directly from the auxiliary device 101 is always selected if the data validity check is positive, without awaiting receipt and quality estimation of the data packet received from the contra-lateral hearing aid, whereby the added time delay due to the relaying may be avoided in these cases. On the other hand, if the data appears corrupted then the selector 207 awaits the data packet from the contra-lateral hearing aid in order to find out whether those payload data may be considered valid and if this is the case the data packet may be provided to the digital signal processor 202. If stereo signals are transmitted as left and right channel mono signals then the data packet received directly from the auxiliary device 101 will always be selected if the data validity check is positive.

In another variation of the present invention the transmission of data packets from the auxiliary device 101 and to both hearing aids 102, 103, is changed to only transmitting the data packet to one of the hearing aids in response to a trigger event selected from a group comprising: low power supply for at least one of the hearing aids, elapse of a predefined duration of time wherein data validity check for the data packet received directly from the auxiliary device has only been successful or has only been failed by one of the hearing aids, and wherein the step of selecting either of the two data packets is replaced by the step of selecting the only data packet that is available from either the auxiliary device or from the contra-lateral hearing aid. According to a further variation the two hearing aids alternate in taking turns on receiving data packets directly from the auxiliary device. In this way the power saved by each of the two hearing aids can be approximately the same and the battery drain can be equalized, which significantly facilitates the battery replacement procedure for the hearing aid user because it allows the batteries for the two hearing aids to be replaced at the same time.

According to another variation the relaying of data packets according to the invention is only activated in response to an indication that streaming of audio data from the auxiliary device 101 and to the hearing aids 102. 103 is about to take place.

It should be appreciated that this method of operating a system with three independent devices is especially advantageous for a binaural hearing aid system because much of the data transmitted from the master is either data whose only purpose is to maintain the connection or is data that is adapted to trigger the same specific effect in both hearing aids at the same time. Thus most of the time the data, to be transmitted to the two hearing aids, is the same. This is e.g. the case for streaming of mono audio and for streaming of stereo audio, wherein both the left and the right stereo signals are transmitted in the same data packet. This is also the case for any type of broadcasting to the binaural hearing aid system.

According to a variation stereo audio may be streamed from the auxiliary device as two different (right and left) mono signals to each of the two hearing aids, and for this situation the hearing aids may be adapted to predict a missing or erroneous mono signal based on the available mono signal. In an embodiment the predicted signal is provided as the output signal from an adaptive filter using the contra-lateral mono signal as input signal. According to this embodiment the adaptive filter setting is optimized using an error signal based on the difference between the output signal from the adaptive filter and the ipse-lateral mono-signal and wherein the adaptive filter setting is kept constant and used to predict the ipse-lateral mono-signal, based on the contra-lateral signal, in case the ipse-lateral mono-signal is not available.

Other examples of data that are relevant for both hearing aids at the same time includes data representing commands for changing volume, for changing a hearing aid program, for changing some other hearing aid setting.

In further variations the methods and selected parts of the hearing aid according to the disclosed embodiments may also be implemented in systems and devices that are not hearing aid systems (i.e. they do not comprise means for compensating a hearing loss), but nevertheless comprise both acoustical-electrical input transducers and electro-acoustical output transducers. Such systems and devices are at present often referred to as hearables. However, a headset is another example of such a system.

In still other variations the invention may be implemented by a non-transitory computer readable medium carrying instructions which, when executed by a computer, cause the methods of the disclosed embodiments to be performed.

Other modifications and variations of the structures and procedures will be evident to those skilled in the art.

The invention claimed is:

1. A binaural hearing aid system comprising:

a first hearing aid, a second hearing aid and an auxiliary device;

a wireless inductive link adapted to transmit data packets between the first and second hearing aids;

a wireless far-field link adapted to transmit data packets from the auxiliary device and to the first and second hearing aid respectively;

wherein both the first and the second hearing aid comprises:

a relay processor adapted to relay data packets received from the auxiliary device, to using the wireless radio link, to the other hearing aid of the binaural hearing aid system, using said wireless inductive link;

a quality estimator adapted to estimate the quality of the data packets received from the auxiliary device using the wireless radio link and adapted to estimate the quality of the data packets received from the other hearing aid of the binaural hearing aid system using the wireless inductive link, wherein the quality estimation is carried out as a data packet validity check selected from a group comprising cyclic redundancy check, parity bit check and hash sum check; and a selector adapted to select either a data packet received from the contra-lateral hearing aid of the binaural hearing aid system or a data packet received from the auxiliary device for further processing by the hearing aid, wherein the selection depends on the data packet validity check.

2. The binaural hearing aid system according to claim 1, wherein the selection only depends on the data packet validity check.

3. The binaural hearing aid system according to claim 1, wherein the relay processor is adapted to relay all data packets, received from the auxiliary device, using the wireless radio link, to the contra-lateral hearing aid of the binaural hearing aid system, using said wireless inductive link.

4. The binaural hearing aid system according to claim 1, wherein the data packets are not decoded before being relayed.

5. The binaural hearing aid system according to claim 1, wherein the relay processor is adapted to relay all data packets comprising data representing audio.

6. The binaural hearing aid system according to claim 1, wherein the selector is adapted to always selecting the data packet received directly from the auxiliary device if the data validity check is positive, whereby selection of a correct mono channel from a stereo audio signal is ensured in case each hearing aid only receives one of the mono channels.

7. The binaural hearing aid system according to claim 1, comprising a digital signal processor adapted to carry out the further processing wherein the further processing comprises at least one of the steps of:

decoding payload data, from a selected data packet, in accordance with an audio codec, and processing payload data, from a selected data packet, representing audio in order to alleviate a hearing deficit of a user.

8. A method of operating a binaural hearing aid system comprising the steps of:

providing a first hearing aid, a second hearing aid and an auxiliary device;

providing an wireless inductive link adapted to operationally connect said hearing aids;

providing a wireless far-field link adapted to operationally connect said auxiliary device with each of said hearing aids;

transmitting a data packet, using said wireless far-field link, from the auxiliary device and to each of said hearing aids;

carrying out in each of the two hearing aids the steps of using said wireless inductive link to relay the data packet to the contra-lateral hearing aid;

estimating, the quality of the data packet received directly from the auxiliary device, hereby providing a first data packet quality estimate;

estimating, the quality of the data packet received from the contra-lateral hearing aid hereby providing a second data packet quality estimate;

selecting, either the data packet received directly from the auxiliary device or the data packet received from the contra-lateral hearing aid based on an evaluation of said first and second signal quality estimates;

using the selected data packet for further processing, and wherein the steps of estimating the data packet quality is carried out by performing a data packet validity check selected from a group comprising cyclic redundancy check, parity bit check and hash sum check.

9. The method according to claim 8, wherein the step of using said wireless inductive link to relay the data packet to the contra-lateral hearing aid is carried out for all received data packets.

10. The method according to claim 8, wherein the step of using said wireless inductive link to relay the data packet to the contra-lateral hearing aid is carried out without decoding the data packet before relaying it.

11. The method according to claim 8, comprising the step of always selecting the data packet received directly from the auxiliary device if the data validity check is positive, whereby selection of a correct mono channel from a stereo audio signal is ensured in case each hearing aid only receives one of the mono channels.

12. The method according to claim 8 wherein the step of selecting comprises at least one of the steps of compensating the delayed receipt of the data packet received from the contra-lateral hearing aid and checking packet order information in order to ensure that data packets holding the same payload or that data packets representing the same time instance of a stereo signal are selected between.

13. The method according to claim 8, wherein the step of using the selected data packet for further processing comprises at least one of the steps of:

decoding the payload of the selected data packet in accordance with an audio codec;

processing payload data representing audio in order to alleviate a hearing deficit of a user.

14. The method according to claim 8, wherein the step of transmitting a data packet, using said wireless far-field link, from the auxiliary device and to each of said hearing aids is changed to only transmitting the data packet to one of the hearing aids in response to a trigger event selected from a group comprising: low power supply for at least one of the hearing aids, elapse of a predefined duration of time wherein data validity check for the data packet received directly from the auxiliary device has only been successful or has only been failed by one of the hearing aids, and wherein the step of selecting either of the two data packets is replaced by the step of selecting the only data packet that is available from either the auxiliary device or from the contra-lateral hearing aid.

15. The method according to claim 8 comprising the further steps of:

detecting whether a received data packet comprises data representing part of a stereo audio signal, wherein the stereo audio signal consists of two different mono signals, wherein only one of the two different mono signals is transmitted directly from the auxiliary device and to each of the hearing aids respectively;

predicting a first mono signal part from a missing or invalid data packet based on a second mono signal part from a valid data packet, wherein the first mono signal part is predicted as the output signal from an adaptive filter using the second mono signal part as input signal, wherein the adaptive filter setting has been optimized over time using an error signal based on the difference between the output signal from the adaptive filter and the first mono signal and wherein the adaptive filter setting is kept constant and used to predict the first mono-signal part, based on the second mono-signal part, in case the first mono-signal part is not available.

* * * * *